US007435186B1

(12) United States Patent
Miller

(10) Patent No.: US 7,435,186 B1
(45) **Date of Patent: *Oct. 14, 2008**

(54) GOLF CLUB GRIP

(76) Inventor: R. Lee Miller, 1 Lower Ragsdale Dr., Bldg. 3, Suite 700, Monterey, CA (US) 93940

( * ) Notice: Subject to any disclaimer, the term of this patent is extended or adjusted under 35 U.S.C. 154(b) by 0 days.

This patent is subject to a terminal disclaimer.

(21) Appl. No.: 11/452,888

(22) Filed: Jun. 14, 2006

Related U.S. Application Data

(63) Continuation-in-part of application No. 10/783,011, filed on Feb. 23, 2004, now Pat. No. 7,175,538.

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS

| | | | | |
|---|---|---|---|---|
| 2,437,404 | A * | 3/1948 | Robinson | 473/203 |
| 3,706,453 | A | 12/1972 | Rosasco | 273/81.4 |
| 3,837,647 | A | 9/1974 | Jacques | 273/81 R |
| 4,597,578 | A | 7/1986 | Lancaster | 473/300 |
| 5,058,891 | A | 10/1991 | Takeuchi | 473/201 |
| 5,906,548 | A | 5/1999 | Hadge | 473/206 |
| D449,866 | S | 10/2001 | Miller | D21/747 |
| D504,927 | S | 5/2005 | Miller | D21/756 |
| D504,928 | S | 5/2005 | Miller | D21/756 |
| 6,890,265 | B2 | 5/2005 | Enlow | 473/201 |
| 6,960,144 | B2 * | 11/2005 | Tucker, Sr. | 473/513 |
| 2003/0228929 | A1 | 12/2003 | Miyasu | 473/300 |
| 2005/0187030 | A1 | 8/2005 | Miller | 473/300 |

FOREIGN PATENT DOCUMENTS

JP 2001046568 2/2001

OTHER PUBLICATIONS

U.S. Appl. No. 29/229,971, filed May 13, 2005, Miller.
U.S. Appl. No. 29/229,972, filed May 13, 2005, Miller.
U.S. Appl. No. 29/229,973, filed May 13, 2005, Miller.
U.S. Appl. No. 29/229,974, filed May 13, 2005, Miller.

* cited by examiner

*Primary Examiner*—Stephen L. Blau
(74) *Attorney, Agent, or Firm*—Janine D. Geraigery; Law Offices of J.D. Geraigery, P.C.

(57) ABSTRACT

An improved golf club grip, adaptable to a golf club shaft, which promotes a more correct grip positioning, having a grip body, having a longitudinal axis, a top end with a first diameter and a flared cap with outwardly disposed sides attached thereto, a shaft end with a second diameter, an internal surface, an external surface with a uniformly and progressively increasing diameter from the first diameter to the second diameter, and at least one reminder rib, preferably y-shaped in configuration, extending from the external surface, aligned with the longitudinal axis of the grip body and intersecting with the outwardly sides of the flared cap that allows the golfer to carry or hold the grip more loosely in the fingers because of the reverse taper feature.

3 Claims, 3 Drawing Sheets

GOLF CLUB GRIP

CROSS-REFERENCE TO RELATED APPLICATIONS

This application is a continuation-in-part of patent application Ser. No. 10/783,011 filed on Feb. 23, 2004 now U.S. Pat. No. 7,175,538.

BACKGROUND OF THE INVENTION

1. Field of Invention

This present invention generally relates to golf club grips and, more particularly, to an improved golf club grip having a non-uniform configuration.

2. Description of the Related Art

The game of golf is, by nature, intensely competitive for both professional and recreational players. The lucrative commercial market for improvements to provide these golfers with an "edge" that will improve their games and lower their scores, provides a significant incentive to seek further improvements to even the very best advances to the game. It is well recognized that, to successfully play the game of golf, the player must impose his or her control over the shaft and head of the golf club during the swing. It is also well recognized that the golfer's use of the fingers and palm of each hand is essential in achieving a proper "feel" for the golf club so as to properly control the shaft and head during the swing. How the golfer can best use the fingers and palm of the hands in controlling the club dictates how well a golfer is able to play the game of golf.

Proper finger and timing control over a golf club will dictate the flight of the ball when struck by the golf club. If the face of the golf club does not strike the ball squarely, the flight of the ball will be diverted from the intended direction. Most recreational golfers do not having physical difficulty with grasping and holding a conventional golf club; however most do not have sufficient skill or coordination to strike the golf ball squarely on a consistent basis. As such, the recreational golfer typically "hooks" or "slices" the ball as opposed to hitting the ball straight and in the intended direction. In fact, the Professional Golf Association (PGA) estimates that 98% of all recreational golfers tend to "slice" the ball.

One of the problems inherent in the conventional construction of golf clubs is the substantially uniform and unchanging design and construction of golf club grips. A conventional golf club grip has an external surface which, when mounted on the shaft of a golf club, has a generally cylindrical configuration with the diameter of the grip decreasing in a substantially uniform manner from the cap end of the grip to the shaft end of the grip. Thus, in a conventional golf club grip, the diameter of the shaft end of the grip is less than the diameter of the grip at the cap end of the grip.

For a right-handed golfer, the right hand (dominant hand) is placed below the left hand and is substantially adjacent to the shaft end of the grip. As a general rule, when a right-handed golfer grips the club in this manner, the dominant, right hand provides most of the power when the golf club strikes the ball. The reverse is true for left-handed golfers. Because the golfer's dominant hand will grip the narrow end of the grip with a conventional-taper design, some serious control problems can arise.

The reduced grip diameter at the shaft end may result in the golfer having less control over the alignment of the face of the golf club when it strikes the ball. This loss in control is caused by the golfer's inability to relax the right hand which, in turn, causes tension in the wrists and the arms during the swing. Further, the left hand portion of a conventional grip is larger for the right-handed golfer. The reverse is true for left-handed golfers. This requires the golfer to hold the grip's largest diameter by the two smallest fingers of the hand which, in turn, causes pronation restriction and possible loss of the club during the swing, which is evidenced by a golfer having a hole in the glove due to constant rubbing and wearing away of the glove as a result of this loss of control.

This size issue typically causes the golfer to carry or hold the grip in the palm instead of the fingers which, again, causes tension in both wrists during the swing. The combination of these factors tends to cause the golfer to squeeze the grip which precludes a normal and timely pronation of the hands, which is necessary to keep the club head square when it impacts the ball. This control problem is exacerbated by both the lack of a repeatable means of consistently positioning the golf club in the golfer's hands so that the club face will more consistently impact the golf ball squarely rather than at an angle and by the tendency of the golf club to slip in the golfer's hands, causing a "hook" or a "slice," which results from an off-center impact.

The device disclosed by this application promotes a more correct grip positioning with memory that allows the golfer to carry or hold the grip more loosely in the fingers because of the reverse taper feature. This, in turn, reduces or eliminates hand and/or wrist tension in both hands thereby giving the golfer more control over the swing. Because the swing is now relaxed, the golfer enjoys a natural and full "release" through the golf club's impact with the golf ball which leads to longer and straighter shots and a more enjoyable sport. The device disclosed by this application also promotes consistent positioning of the golf club in the golfer's hands because of the "Y" shaped "reminder rib" feature (such as a baseball pitcher will find a seam on a baseball as reminder for their proper and repeatable finger positioning). The device disclosed by this application works extremely well as evidenced by the on going and increasing commercial success of the device disclosed therein.

U.S. Pat. No. D449,866 issued to Miller (2001) discloses a club head, U.S. Pat. No. D504,972 issued to Miller (2005) discloses a golf club grip, and U.S. Pat. No. D504,928 (2005) discloses a golf club grip. Patents pending and allowed to Miller include Ser. No. 29/229,971 a golf club grip, Ser. No. 29/229,972 a golf club grip, Ser. No. 29/229,973 a golf club grip and Ser. No. 29/229,974 a golf club grip.

U.S. Pat. No. 6,890,265 issued to Enlow (2005) discloses a reverse taper grip for attachment to an elongated golf club shaft or other similar handle or the like, the grip being formed of resilient synthetic resin material and presenting an outer gripping surface of reverse taper design along at least a portion of the grip. No means for consistent positioning, such as a "reminder rib," is disclosed.

U.S. Pat. No. 3,706,453 issued to Rosasco (1972) discloses a golf club with a finger orienting grip having a flat portion combined with finger positioning to desirably orient hands relative to each other.

U.S. Pat. No. 3,837,647 issued to Jacques (1974) discloses a grip with a taper of reverse configuration and a knoblike enlargement acting as a stop at the free end of the grip. No "reminder rib" or other means for consistent positioning is disclosed.

Japanese Patent No. 2001-46568 issued to Hiroshi (2001) discloses golf club grips with a reverse taper but nothing therein describes or even contemplates a means for consistently positioning the golf club in the golfer's hands.

U.S. Pat. No. 5,058,891 issued to Takeuchi (1991) discloses a fitting-angle adjustment mark for a grip of a golf club. The rear end surface of the grip, which fits on the rear portion of a club shaft, provides graduations of the mark directly or by means of an element separate from the grip at predetermined angular intervals with reference to a back line of the grip. A reverse taper grip is not disclosed or described.

U.S. Patent Publication 2003/0228929 submitted by Miyasu (2003) discloses a golf club grip that might have a means to aid the golfer in positioning the golf club in the hands, but does not disclose the use of this structure as a positioning feature. Further, this disclosure does not contemplate the use of such means on anything but a golf club grip with a conventional taper.

U.S. Pat. No. 4,597,578 issued to Lancaster (1986) discloses a golf club grip having a knob at the cap end of the grip with the top third of the grip slightly undersized to help promote hand and wrist action for added power and with less taper and more uniform size at the lower two thirds of the grip to discourage over controlling the club.

U.S. Pat. No. 5,906,548 issued to Hadge (1999) discloses a golf club grip with a knob at the cap end of the grip but does not describe or even contemplate a means for consistently positioning the golf club in the golfer's hands.

The prior art discloses several attempts to address these problems individually, but nothing in the prior art discloses or even suggests a single solution to all of the foregoing problems.

None of the prior art disclosures describe a grip with multiple reminder ribs or ridges, for consistent positioning purposes, nor do they describe a "Y" shaped reminder rib.

While these units may be suitable for the particular purpose employed, or for general use, they would not be as suitable for the purposes of the present invention as disclosed hereafter.

SUMMARY OF THE INVENTION

The present invention has been designed to solve the foregoing problems found in the prior art.

It is an object of the present invention to provide a golf club grip that provides the golfer with repeatable and increased control over the swing of the golf club while not slipping axially or longitudinally in the golfer's hands. Accordingly, the golf club grip of the invention features a flared end-cap that prevents the club grip from axially sliding in the golfer's hands during the swing, prevents the club grip from slipping out of the golfer's hands after impacting the ball, and provides the golfer's counter leverage on the golf club during the swing so as to increase power and accuracy. Additionally, with increased wall stock thickness, it eliminates the possibility of the golf club shaft and its sharp edges from penetrating the end of the grip and possibly causing injury to the golfer.

It is a further object of the present invention to provide a golf club grip and that causes an increase in swing and ball speed while increasing the golfer's leverage and counter leverage on the golf club during the swing. Accordingly, the golf club grip has a shaft end, a top end and an external surface having a diameter, which progressively and uniformly increases from the top end to the shaft end, so that the golfer's dominant hand will grasp the greater diameter of the grip, thereby increasing swing, ball speed, golfer leverage and counter leverage.

It is yet another object of the present device to provide a golf club grip that affords the golfer more finite finger tip positioning and to provide a golf club grip that affords the golfer the ability to carry or hold the grip more loosely in the fingers. Accordingly, the device has at least one, preferably two or three reminder ribs longitudinally position along the internal surface of the grip, which creates a tactile surface, decreasing tension in the hand and/or wrist and improving the golfer's grip of the club.

It is another object of the present device to provide a golf club grip that permits the golfer consistent positioning of the grip, that causes the hands and fingers of the golfer to fully release during the swing through impact, and that provides a golf club grip with more than one means of permitting the golfer to consistently position the golf club every time it is used, thereby increasing a player's power, ball speed, accuracy, and distance. Accordingly, the present device includes at least one reminder rib, preferably Y-shaped, that provides for consistent and repeatable finger placement and positioning, increases the Moment of Inertia (MOI) relative to the golf club head, reduces the torques around the longitudinal axis of the club, and allows the golfer to position the club in such a manner as to induce a controlled draw or fade on the flight of the ball after impact.

It is yet a further object of the present device to provide an improved golf club grip which is simple and inexpensive to fabricate. Accordingly, the golf club grip of the invention is constructed of moldable, resilient material, thereby providing a more simple and inexpensive grip to fabricate.

The invention is an improved golf club grip adaptable to a golf club shaft, which promotes a more correct grip positioning, having a grip body, having a longitudinal axis, a top end with a first diameter and a flared cap with outwardly disposed sides attached thereto, a shaft end with a second diameter, an internal surface, an external surface with a uniformly and progressively increasing diameter from the first diameter to the second diameter, and at least one visible and tactilely discernable reminder rib, preferably y-shaped in configuration, extending from the internal surface, aligned with the longitudinal axis of the grip body and intersecting with the outwardly sides of the flared cap that allows the golfer to carry or hold the grip more loosely in the fingers because of the reverse taper feature.

Further additional objects, advantages and features of the invention will become apparent in part from a consideration of the drawings and the ensuing description and will become apparent in part to those having ordinary skill in the art upon examination of the following drawings and description of the invention or learned from the practice of the invention.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DIAGRAM NUMBERS

10—conventional golf club
11—standard golf club shaft
12—grip
13—cap end
14—shaft end
20—improved golf club grip
20D—external diameter of grip
21—cylindrical golf club shaft
22—grip body
23—outer cylindrical surface
24—top end of gripbody
24D—first diameter at top end
25—open shaft end of gripbody
25D—second diameter at shaft end
26—outer surface of gripbody
27—inner surface of gripbody
27A—cylindrical cavity of gripbody
28—closed outwardly flared end cap
28A—outwardly disposed sides of flared end cap
29—reminder rib
30—longitudinal axis
31—reverse taper of gripbody
32—Y-shaped structure
33—inner rod
35—diverging arms of Y-shaped structure
36—intersection of flared end cap and reminder rib

DETAILED DESCRIPTION OF THE PREFERRED EMBODIMENTS

An understanding of the present invention can be best gained by reference to FIGS. 1 through 8, inclusive.

Figure 1:
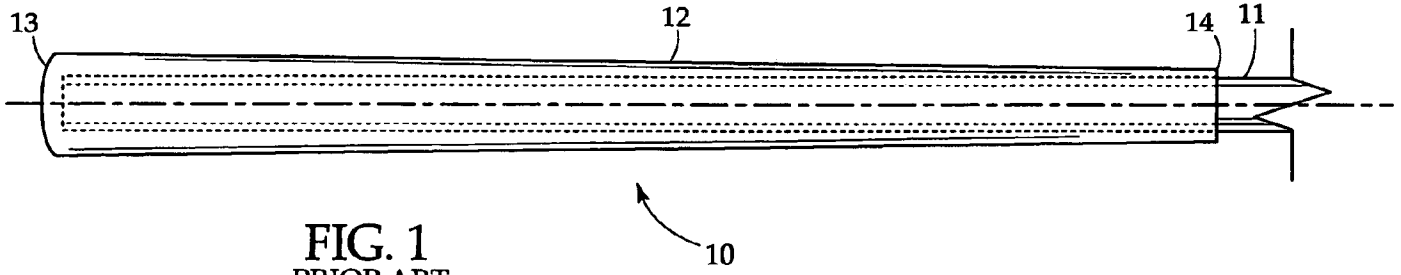
FIG. 1 PRIOR ART
FIG. 1 is a diagrammatic perspective view of a conventional golf club grip of the prior art.

FIG. 1 illustrates a conventional golf club 10, which employs a standard shaft 11, which is typically circular in circumference. A grip 12 is mounted upon an end of shaft 11 opposite the club head (not shown). The grip 12 is made of moldable, resilient material and has an internal diameter slightly smaller than the external diameter of shaft 11. The grip 12 has a cap end 13 and a shaft end 14 with the diameter at the cap end 13 being greater than the diameter at the shaft end 14.

Figure 2:
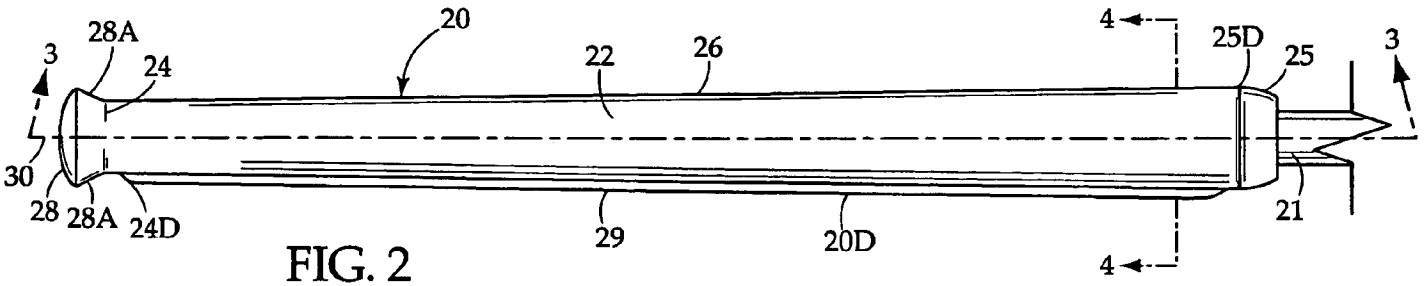
FIG. 2 is a side elevation view of the improved golf club grip of the present invention, having a flared end cap.
Figure 3:
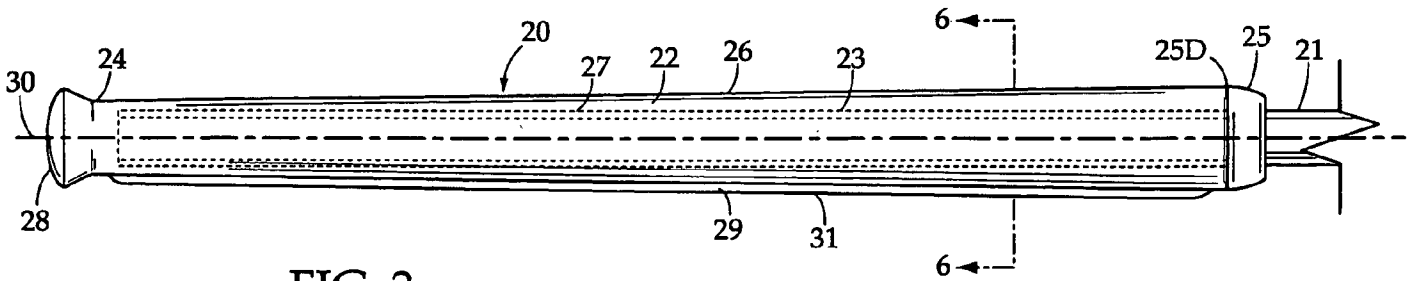
FIG. 3 is a cross-sectional view of the improved golf club grip of the present invention shown in FIG. 2 taken through line 3-3 of FIG. 2.

FIGS. 2 and 3 illustrate the preferred embodiment of the present invention which comprises an improved golf club grip 20, to be used by a golfer. The palms of the golfer hold the golf club grip 20, having an external diameter 20D and the fingers wrap there around. For simplicity and to avoid confusion with grip 20, such manner of gripping or holding the golf club grip 20 shall be referred to hereinafter as grasping. The golf club grip 20 is mounted to a cylindrical golf club shaft 21. Although the golf club grip 20 is described with respect to its use in combination with a conventional cylindrical golf club shaft 21, it is understood by those skilled in the art that golf club shafts having different configurations can be used in combination with the present invention grip 20.

Referring to FIGS. 2 and 3, the grip 20 consists of a moldable resilient rubber, plastic or like material with an elongated grip body 22 which is disposed about an outer cylindrical surface 23 of shaft 21, having a longitudinal axis 30. The grip 20 has an outer surface 26, an inner surface 27, an open shaft end 25, which is closest to the golf club head (not shown), and a top end 24. A closed outwardly flared end cap 28 is adjacent to the top end 24, and has outwardly disposed sides 28A, which flare outwardly and upwardly from the grip body 22.

Figure 4:
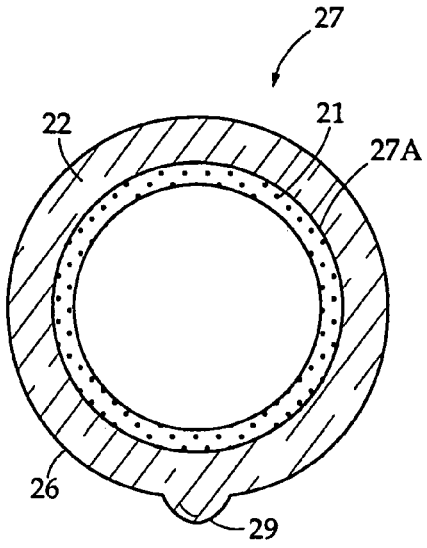
FIG. 4 is a cross-sectional view of the improved golf club grip of the present invention shown in FIG. 2 taken through line 4-4 of FIG. 2.

FIG. 4 illustrates the inner surface 27 of the grip body 22 having an elongated substantially cylindrical cavity 27A, disposed through the shaft end 25 (shown in FIG. 3) coaxially and through the longitudinal axis 30 of the grip body 22 and adapted to receive the shaft 21. The cylindrical cavity 27A (shown in FIG. 4) has a diameter which is slightly less than the outer diameter of shaft 21, causing the grip body 22 to stretch around the shaft 21, ensuring a secure fit of the grip body 22 to the shaft 21.

Referring to FIGS. 2 and 3, the outer surface 26 of grip body 22 is substantially frusto-conical in configuration having a reduced first diameter 24D at top end 24 of grip 20 and an increased second diameter 25D at the shaft end 25. The external diameter 20D of the grip 20 progressively and uniformly increases along the grip body 22 from the first diameter 24D at top end 24 to the second diameter 25D of the shaft end 25 of the grip 20, such that the grip body 22 defines a reverse taper 31. This reverse taper 31 configuration, is more anatomically correct than the configuration of a conventional golf club 10 and grip 12 (shown in FIG. 1) and promotes a more correct grasp by the golfer when holding the golf club grip 20, by allowing the golfer to position the grip body 22 more loosely in the fingers. This, in turn, reduces or eliminates hand and/or wrist tension in both hands of the golfer thereby giving the golfer more control.

In the preferred embodiment of the present invention (shown in FIGS. 2-3) the second diameter 25D of grip body 22 at the shaft end 25 is within the range of 0.92 inches to 0.95 inches and the first diameter 24D of grip body 22 at the top end 24 is in the range of 0.77 inches to 0.80 inches. It is understood by persons having skill in the art that the first and second diameters, 24D and 25D, of the grip body 22 at the top end 24 and the shaft end 25, respectfully, may be altered to adapt the grip body 22 to the physical size of the golfer. However, the second diameter 25D of grip body 22 at the shaft end 25 is always larger than the first diameter 24D at the top end 24.

To provide more control and power, the present invention provides the flared end cap 28, shown in FIGS. 2 and 3. The flared end cap 28 increases the counter leverage and prevents the golf club grip 20 from slipping out of the golfer's hands upon completion of the swing.

Figure 5:
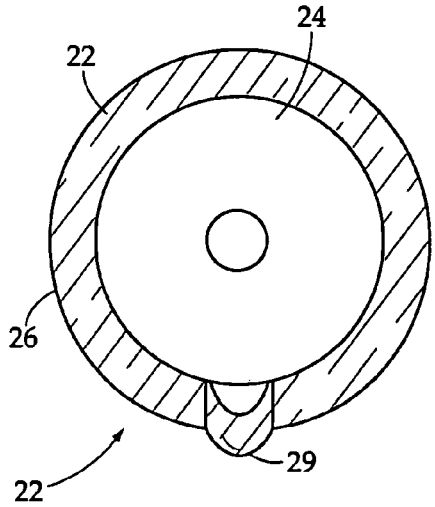
FIG. 5 is an end cap view of the improved golf club grip of the present invention.
Figure 6A:
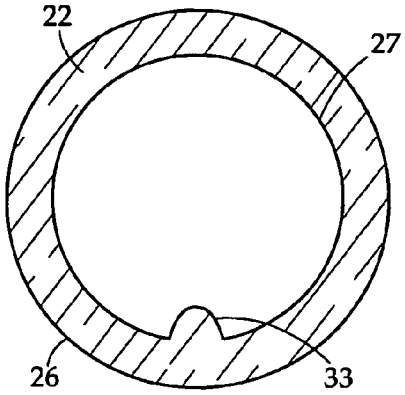
FIG. 6A is a partial, cross-sectional view of the improved golf club grip of the present invention taken through line 6-6 of FIG. 3 prior to the golf club shaft being inserted into the grip body.
Figure 6B:
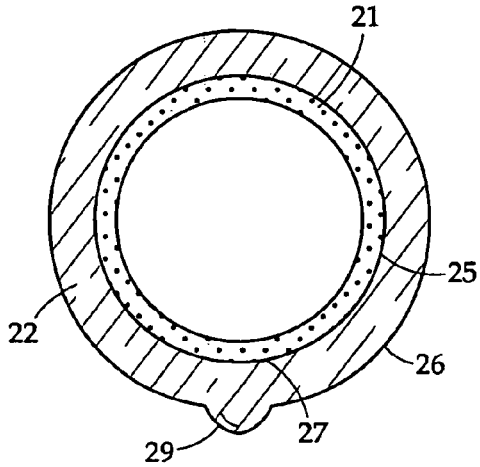
FIG. 6B is a partial, cross-sectional view of the improved golf club grip of the present invention taken through line 6-6 of FIG. 3 after the golf club shaft is inserted into the grip body.

To provide even further control, the present invention provides several means for consistent positioning of the grip 20 in the hands of the golfer. In the preferred embodiment, as shown in FIGS. 2-6B, the outer surface 26 of the grip body 22 has at least one visible and tactilely discernable reminder rib 29, preferably integrally coupled thereto, which extends upwardly from the inner surface 27 of the grip body 22. The reminder rib 29 extends continuously from the top end 24 of the grip body 22 to the shaft end 25 of the grip body 22 and is substantially aligned with the longitudinal axis 30 of the golf club shaft 21 and is adapted to be in contact with golfer's fingers when the golfer is holding the grip body 22. The reminder rib 29 may be integrally molded or cast on the outer surface 26 of the grip body, as shown in FIG. 5, or alternatively as shown in FIG. 6A. The reminder rib 29 may be integrally molded or cast as a longitudinally aligned inner rod 33 on the inner surface 27 of the grip body 22, as shown in FIG. 6A, and inserting the golf club shaft 21 into grip body 22 thereby causing upward displacement of a longitudinally aligned inner rod 33. The upwardly displaced inner rod 33 extends radially from inner surface 27 of grip body 22, creating the reminder rib 29, as illustrated in FIG. 6B.

Figure 7:
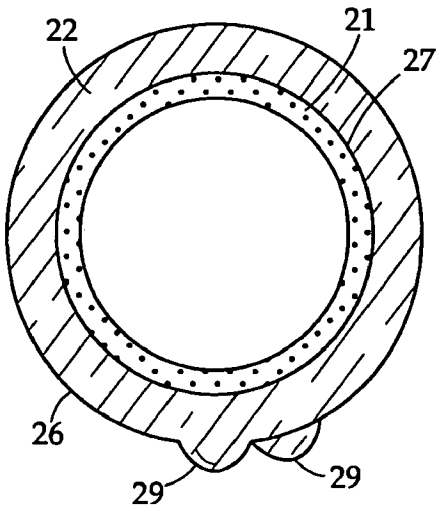
FIG. 7 is a cross-sectional view of an alternate embodiment of the improved golf club grip of the present invention shown in FIG. 2 taken through line 4-4 of FIG. 2 having parallel reminder ribs.

In one alternate embodiment, illustrated in FIG. 7, a pair of reminder ribs 29 may extend parallel and continuously from the shaft end 25, shown in FIGS. 2-3, of the grip body 22 to the top end 24 of the grip body 22 and being substantially aligned with the longitudinal axis 30 of the shaft 21 and adapted to be in contact with golfer's fingers when the golfer is holding the grip body 22.

Figure 8:
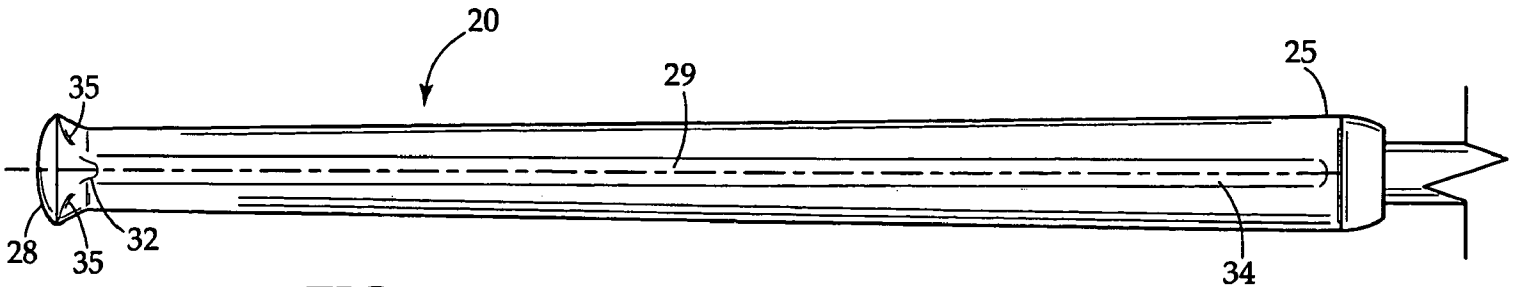
FIG. 8 is a diagrammatic perspective view of another alternate embodiment of the improved golf club grip of the present invention having a Y-shaped reminder rib.

In another embodiment, illustrated in FIG. 8, the reminder rib 29 intersects with the flared cap 28. At the intersection 36 of the flared end cap 28, a Y-shaped structure 32 extends from the reminder rib 29. The Y-shaped structure 32 has diverging arms 35 relative to outer surface 26. The Y-shaped structure 32 extends longitudinally and continuously from the shaft end 25. The Y-shaped structure 32 has diverging arms 35 which form approximately a twenty-five degree angle therebetween and intersect outwardly disposed sides 28A of flared end cap 28. The "Y" shaped structure 32 intersecting with the flared end cap 28 provides the golfer with a finger rest, which offers a tangible and subliminal reminder to the golfer as to where the golf club grip 20 should be positioned in the hands, enabling the golfer to repetitively and consistently position the grip 20 within the hand. Consistent and correct positioning increases the moment of inertia (MOI) relative to the golf club head (not shown), reduces torque and allows the golfer to position the club in such a manner as to induce a controlled draw or fade on the flight of the ball after impact.

It is understood by persons having skill in the art that the reminder rib 29, in additional embodiments, may include multiple ribs, parallel or non-parallel, and may be disposed in forms other than that of the preferred or alternate embodiments described above. For example, but not limited to, the reminder rib 29 or ribs, may be continuously disposed along the longitudinal axis of grip 20, having, without limitation, a rectangular, triangular, trapezoidal, or semi-circular vertical cross-section. Similarly, the reminder rib 29 may be continuously disposed along the longitudinal axis of grip 20, having, without limitation, a rectangular or trapezoidal horizontal cross-section.

In conclusion, herein is presented a golf club grip. The invention is illustrated by example in the drawing figures, and throughout the written description. It should be understood that numerous variations are possible, while adhering to the inventive concept. Such variations are contemplated as being a part of the present invention.

I claim:

1. An improved golf club grip coupled on a cylindrical golf club shaft, having a longitudinal axis, for use by a golfer, said grip comprising:

an elongated body, having a longitudinal axis and having a top end and an open shaft end, said top end having a first diameter, approximately in the range of 0.77 inches-0.80 inches, and said shaft end having a second diameter, approximately in the range of 0.92 inches-0.95 inches, defining a reverse taper defined by progressively and uniformly increasing external diameter from said first diameter to said second diameter;

a closed outwardly flared end cap coupled to said top end having outwardly disposed sides, such that the external diameter of said grip body progressively and uniformly increases from the flared cap end to the shaft end along the grip body;

an inner surface having an elongated substantially cylindrical cavity disposed coaxially through said shaft end and disposed through the longitudinal axis of said grip body which is adapted to receive the golf club shaft;

an outer surface having a substantially frusto-conical configuration throughout said grip body;

one integrally coupled rib extending from the inner surface of said grip body when said grip is not coupled to a shaft in alignment with the longitudinal axis of said golf club shaft, a reminder rib extending outwardly from the outer surface of said grip produced when said grip is coupled to a shaft wherein said reminder rib intersects said outwardly disposed sides of the flared end cap, and wherein said reminder rib extends continuously from the top end to the shaft end of said grip body, wherein said reminder rib is adapted in cooperation with the increasing diameter of said grip body from said top end to said shaft end; and a Y-shaped structure, wherein the diverging arms of said structure form a twenty-five degree angle therebetween and intersect the outwardly disposed sides of the flared cap, wherein, the intersection of the reminder rib with the flared end cap provides the golfer with a type of finger rest, which provides a tangible and subliminal reminder to the golfer as to where the golf club grip should be positioned in the hands of the golfer.

2. The improved golf club grip as defined in claim 1 wherein said reminder rib is from the group consisting of rectangular, triangular, trapezoidal, or semi-circular ribs.

3. An improved golf club grip coupled on a cylindrical golf club shaft, having a longitudinal axis, for use by a golfer having hands, said grip comprising:

an elongated body, having a longitudinal axis and having a top end and an open shaft end, said top end having a first diameter and said shaft end having a second diameter defining a reverse taper defined by progressively and uniformly increasing external diameter from said first diameter to said second diameter;

an inner surface having an elongated substantially cylindrical cavity disposed coaxially through said shaft end and disposed through the longitudinal axis of said grip body which is adapted to receive the golf club shaft;

an outer surface having a substantially frusto-conical configuration throughout said grip body; and one integrally coupled rib extending from the inner surface of said grip body when said grip is not coupled to a shaft in alignment with the longitudinal axis of said golf club shaft, a reminder rib extending outwardly from the outer surface of said grip produced when said grip is coupled to a shaft wherein said reminder rib intersects said outwardly disposed sides of said flared cap, defining a Y-shaped structure forming a twenty-five degree angle therebetween and intersecting the outwardly disposed sides of the flared cap, wherein, the intersection of the reminder rib with the flared end cap provides the golfer with a type of finger rest, which provides a tangible and subliminal reminder to the golfer as to where the golf club grip should be positioned in the hands of the golfer.

* * * * *